United States Patent [19]

Barker

[11] Patent Number: 4,807,420

[45] Date of Patent: Feb. 28, 1989

[54] HORIZONTAL FORM-FILL-SEAL PACKAGING MACHINES

[76] Inventor: Michael J. Barker, Unit 21, Aylesbury Valve Industrial Park, Farmbrough Close Stocklake, Aylesbury-Buckinghamshire, England, HP20 1DQ

[21] Appl. No.: 945,712

[22] Filed: Dec. 23, 1986

[30] Foreign Application Priority Data

Dec. 24, 1985 [GB] United Kingdom ..... 8531796
Apr. 17, 1986 [GB] United Kingdom ..... 8609429

[51] Int. Cl.[4] ..... B65B 9/08; B65B 57/04; B65B 57/06; B65B 57/08

[52] U.S. Cl. ..... 53/51; 53/550

[58] Field of Search ..... 53/51, 450, 451, 550, 53/551, 552, 373; 198/394, 412, 413

[56] References Cited

U.S. PATENT DOCUMENTS

| | | | |
|---|---|---|---|
| 3,068,989 | 12/1962 | Packman et al. | 198/382 |
| 3,589,095 | 6/1971 | James . | |
| 3,601,240 | 8/1971 | Dominici | 198/382 |
| 4,012,888 | 3/1977 | Nichols | 53/131 |
| 4,376,481 | 3/1983 | Franklin | 198/413 X |
| 4,525,977 | 7/1985 | Matt | 53/550 X |
| 4,545,174 | 10/1985 | Seko . | |
| 4,549,386 | 10/1985 | Wilson | 53/550 X |
| 4,574,566 | 3/1986 | Eaves et al. | 53/550 X |

FOREIGN PATENT DOCUMENTS

| | | |
|---|---|---|
| 0018041 | 10/1980 | European Pat. Off. . |
| 0084299 | 7/1983 | European Pat. Off. . |
| DE2656218 | 6/1978 | Fed. Rep. of Germany . |
| 2006707 | 5/1979 | United Kingdom . |
| 2138381 | 10/1984 | United Kingdom . |

*Primary Examiner*—Horace M. Culver
*Attorney, Agent, or Firm*—Cushman, Darby & Cushman

[57] ABSTRACT

The invention relates to a horizontal form-fill-seal packaging machine in which a horizontal form-fill-seal packaging machine is provided a plurality of modules for carrying out successive stages of form-fill-seal packaging process, the modules being mechanically separate from one another and including at least one stepper motor drive, the stepper motors all being controlled and synchronized by a microprocessor. This results in a packaging machine which can be efficiently fabricated, installed and maintained and which can perform highly accurate, synchronized, high speed automatic wrapping.

9 Claims, 4 Drawing Sheets

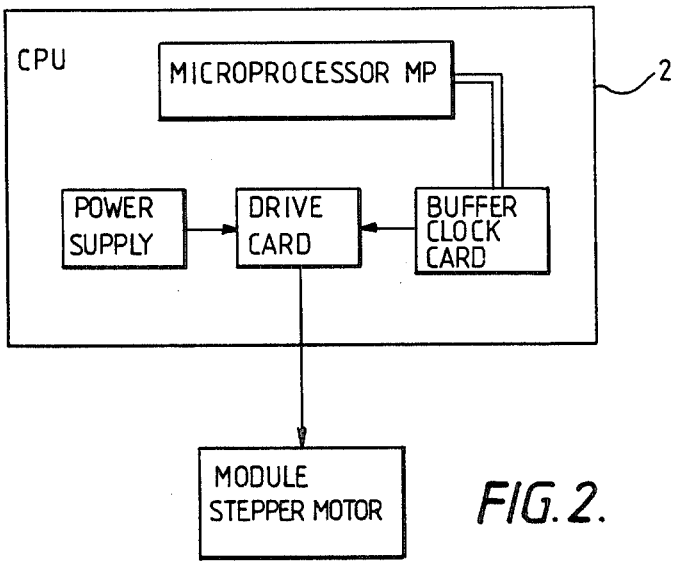
FIG. 2.
FIG. 5.
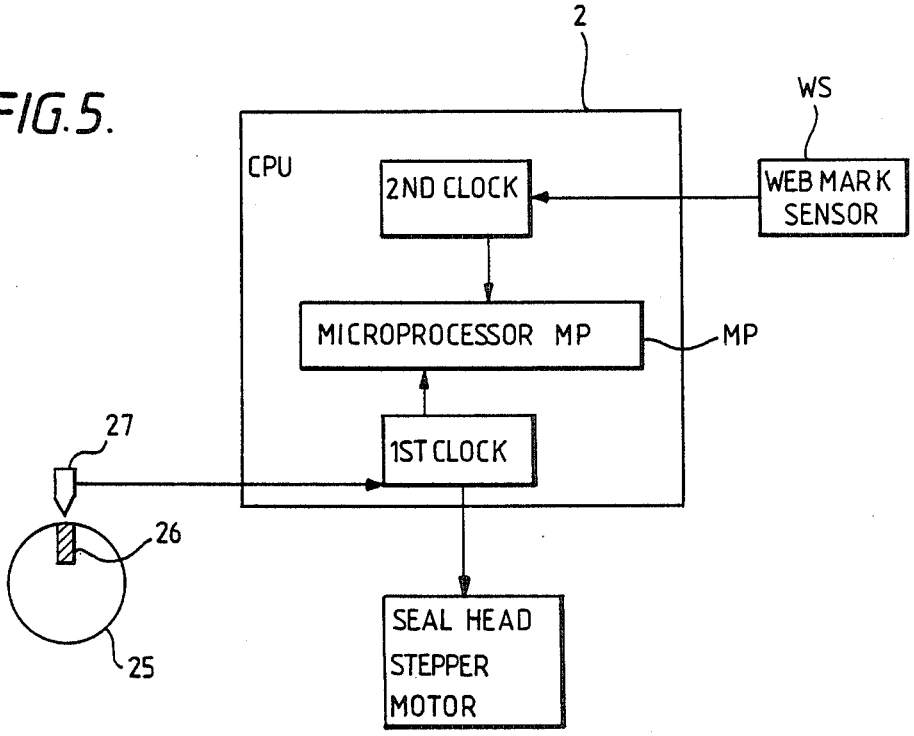

HORIZONTAL FORM-FILL-SEAL PACKAGING MACHINES

This invention relates to horizontal form-fill-seal packaging machines. Such machines automatically package successive single or multiple items, for instance food, confectionery, pharmaceuticals, cosmetics, toiletries, stationery, and other consumer products. Elongate articles, such as confectionery bars, are conveniently wrapped in machines of this kind. Horizontal form-fill-seal packaging (HFFS) machines form a web of paper or other wrapping material into a tube surrounding a product, seal the web longitudinally to complete the tube, and seal and cut the tube transversely into individual packages. The term horizontal form-fill-seal-packaging machine is used herein to mean machines which are operated horizontally or substantially horizontally for maximum speed and reliability of wrapping but also includes machines inclined to the horizontal and in which the gravitational pull on the product is not sufficient to adversely affect the throughput of the product and web tube.

In a conventional HFFS packaging machine, the parts of the machine are controlled by a main drive source via chain and gear systems. Whenever access to any part is needed such as for maintenance or cleaning, it is necessary to shut down the whole machine and to manually readjust the relative timing of the different parts when ready to start the machine up again. Actual maintenance and cleaning of the individual mechanical parts is difficult and time-consuming. Exchanging or adjusting parts of the machine according to different product sizes involves lengthy readjustment and replacement procedures. Also, the mechanical linkages will be subject to wear and themselves eventually require replacement. As a result there will be lost production capacity whenever access to the machine is required.

Accordingly, it is an object of this invention to provide a horizontal form-fill-seal packaging machine to which access can be obtained without significant loss of production capacity, which can be efficiently maintained and cleaned, and which can be adapted for different product sizes quickly and simply.

Other important objects of the invention are precise web-product registration and high packaging speed.

According to the invention, we propose a horizontal form-fill-seal packaging machine comprising a plurality of modules for carrying out successive stages of a form-fill-seal packaging process, the modules being mechanically independent of one another. Thus, there are no mechanical linkages between successive modules. The modules are arranged in successive functional order in the machine so that a product may travel continuously through the machine before and after packaging. Each module is a mechanically self-contained unit, the functional elements being confined within the module. This allows each module to be removed from the machine without mechanical detachment from any neighbouring module and similarly to be put back or to be replaced by a different module. Hence the modules can be removed without tools. The machine is therefore straightforward to manufacture and assemble.

Modules can be exchanged for a module of the same type to allow access to the removed module for repair or cleaning, or exchanged for a module of a different type to accommodate a change in the packaging process for example for changing from packaging products singly to in multiples. There is no need to keep the machine shut down while a module is being repaired or cleaned and the machine can continue to run without significant loss of production capacity by exchanging modules.

Individual modules are direct motor driven, thus obviating awkward gears, chains or other mechanical linkages within the modules, so that the modules are simple to clean and maintain.

In the preferred embodiment each module has its own drive unit, and a central processing unit individually controls the drive units, preferably in the form of a microprocessor. Thus the performance of the individual modules and the timing relationship between respective modules are dictated centrally. The drive units are in the form of stepper motors through which precise control of the performance characteristics of the modules is achieved by the central processing unit.

Means of sensing the product and/or web may be provided so that the drive units can be controlled in accordance with the information received from the respective modules. The performance characteristics of the individual modules can therefore be optimised with respect to one another by the central processing unit to carry out automatic packaging with maximum possible efficiency and speed. The web may have a series of regularly-spaced marks, which are each sensed photoelectrically by a sensor upstream of the tube former. Each package length may include at least one web mark. Advantageously, the timing of a driven product arrester member may be adjustable for each product so as to regulate the infeed of products into the tube former, in accordance with the time of sensing of the reference mark of that particular package length upstream in the web infeed module. This will be discussed in more detail below. In another advantageous application preferably employed as well as the adjustable arrester timing, the timing of the seal for each respective package length is adjustable in accordance with the time of sensing of the reference mark of that particular package length sensed upstream.

This is especially important in that the products can be accurately positioned with respect to the web tube and/or the seal and cut-off can be accurately positioned with respect to the web tube. This allows high speed packaging and also significant savings in packaging material. A 10–20% saving in material can be achieved. The improved efficiency of the machine results in much lower packaging costs. Moreover, the machine can be adapted to customer requirements.

The strict control of the web tube throughout the machine of this invention allows great flexibility e.g. a wide range of product sizes and types can be wrapped. The packaging machine can be run at very high speeds, e.g. up to 300–400 cm. per sec. and therefore products can be wrapped very fast. Furthermore, it is possible to use thin packaging material in the machine of this invention, such as polypropylene, polypropylene laminates, paper, paper laminates, foil, foil laminates, and cellophane, e.g. metal foils of the order of 15–20 $\mu$ thick. Substantial material savings of at least 20%, and hence reduced packaging costs, are possible.

One problem which arises during conveying of products along the machine to the tube former is that of product damage. If the products are transported end-to-end all the way along the packaging machine, the products may be damaged, for example the corners may be lost, due to the pressure exerted on the trailing end of the product by all the abutting upstream products. Accordingly, it is an object of the invention to avoid damage to the products being conveyed.

The invention provides a method and apparatus for conveying products in a horizontal form-fill-seal packaging machine in which the incoming products are supplied sequentially with their broad-sides perpendicular to the direction of travel, and sequentially turned into an end-wise orientation before the products are wrapped.

This avoids the risk of damage to the products due to pressure from products upstream and also allows products to be fed more accurately.

The turning of the products may be achieved by a process and apparatus for feeding the products in at a first speed and in a first direction of travel, accelerating a first end of each product in or opposite to the direction of product travel, and downstream of the accelerating, sending the opposite end of said each product in the opposite direction to the direction of travel of the first end. Preferably, the first end is accelerated in the first direction of travel and the direction of travel of the opposite end is reversed.

The reversing may comprise conveying the opposite end of the product at a second speed, which is greater than the first speed. The accelerating may comprise conveying the first end of the product at a third speed, which is greater than the second speed. The first and second means may comprise endless belts.

In horizontal form-fill-seal packaging machines, in order to transversely seal entubed products, a seal head is mounted on an arbour through which the tube containing the product passes. The sealing may be effected by pressure alone, or in some cases a heated seal head may be employed.

To perform the sealing operation, the seal head must be moving at the same speed as the entubed product at the instant that the seal is being made. Also, it is of course necessary that the distance between successive seals should be equal to the package length. This means that if the product length, and therefore the package length, is changed, the average rotational speed of the sealing arbour must change, although the speed of the sealing heads at the moment of making a seal remains the same. The arbour carrying the seal head must therefore execute an adjustable, non-uniform rotation. In the past this has been accomplished by the use of an epicyclic gear system, and an example of a packaging machine showing such an epicyclic system is described in British Pat. No. 1,362,060.

The pressures required for the sealing and cutting operations are considerable, and the respective machine parts must be robustly constructed. They are therefore of considerable mass and inertia, and their non-uniform speed of movement results in a degree of vibration which is objectionable, and which leads to rapid wear of the components and the efficiency of the machine is lowered.

It is another object of the present invention to provide an HFFS machine in which these disadvantages are eliminated. It is a yet further object of the invention to be able to precisely define the seal or seal-and-cut position for each package.

In the present invention, the use of epicyclic gearing or other mechanical arrangements liable to excessive vibration is avoided, the seal head is being driven by a stepper motor operated in the required rotational speed pattern by pulses derived from the central processing unit and the pattern for each packaging length is specified in accordance with web mark detection upstream for the respective package length. The seal head may also include cutting means for severing the package although for further reducing the forces involved, the sealing and cutting steps may be separate. The cutting head may also be driven by its own stepper motor under control of the central microprocessor.

A preferred embodiment of a horizontal form-fill-seal packaging machine according to the invention will be described by way of example and with reference to the drawings, in which:

FIG. 2 is a schematic diagram showing the electronic interfacing of the central processing unit with a module.

FIG. 5 is a schematic block diagram showing a seal positioning system.

Figure 1:
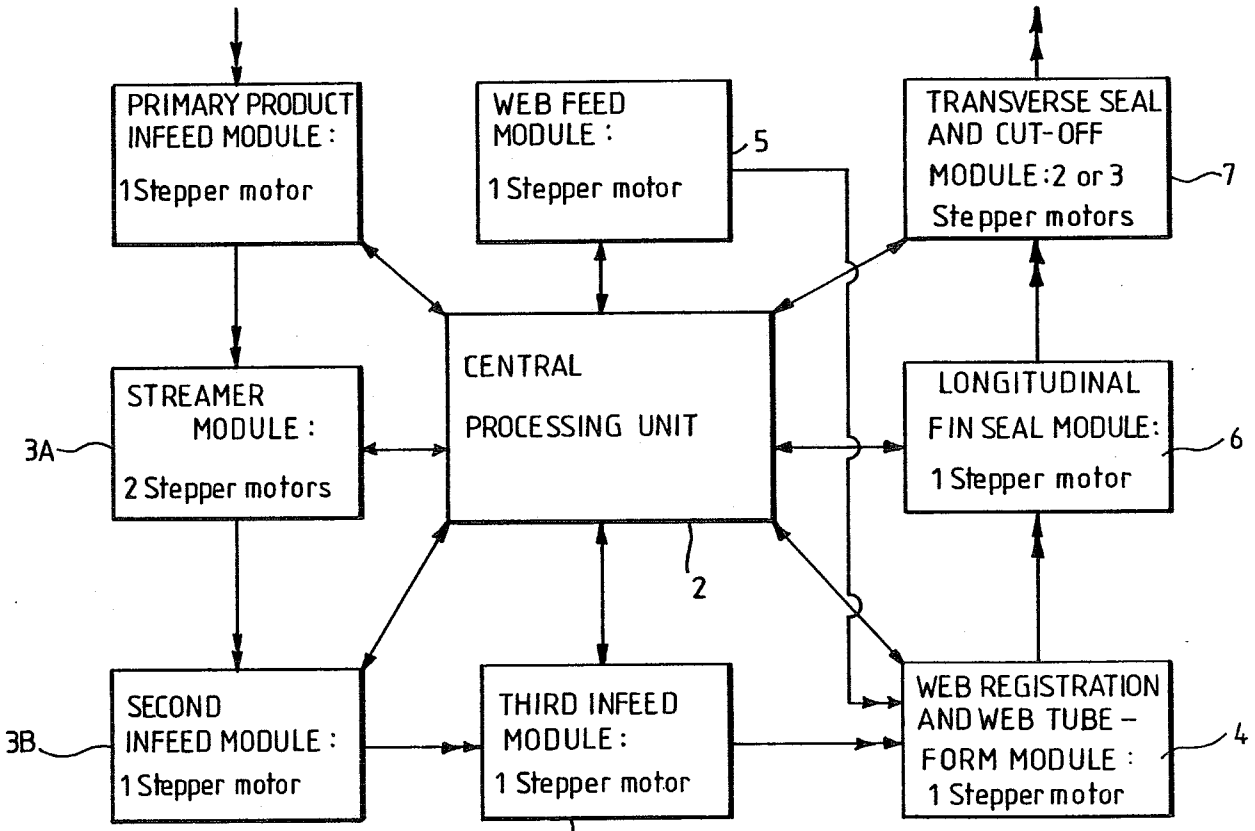
FIG. 1 is a schematic block diagram of a horizontal form-fill-seal packaging machine, in which the single-headed arrows show connection of modules with a central processing unit and double-headed arrows show the path of web and/or product; the deployment of stepper motors is also shown.
Figure 3:
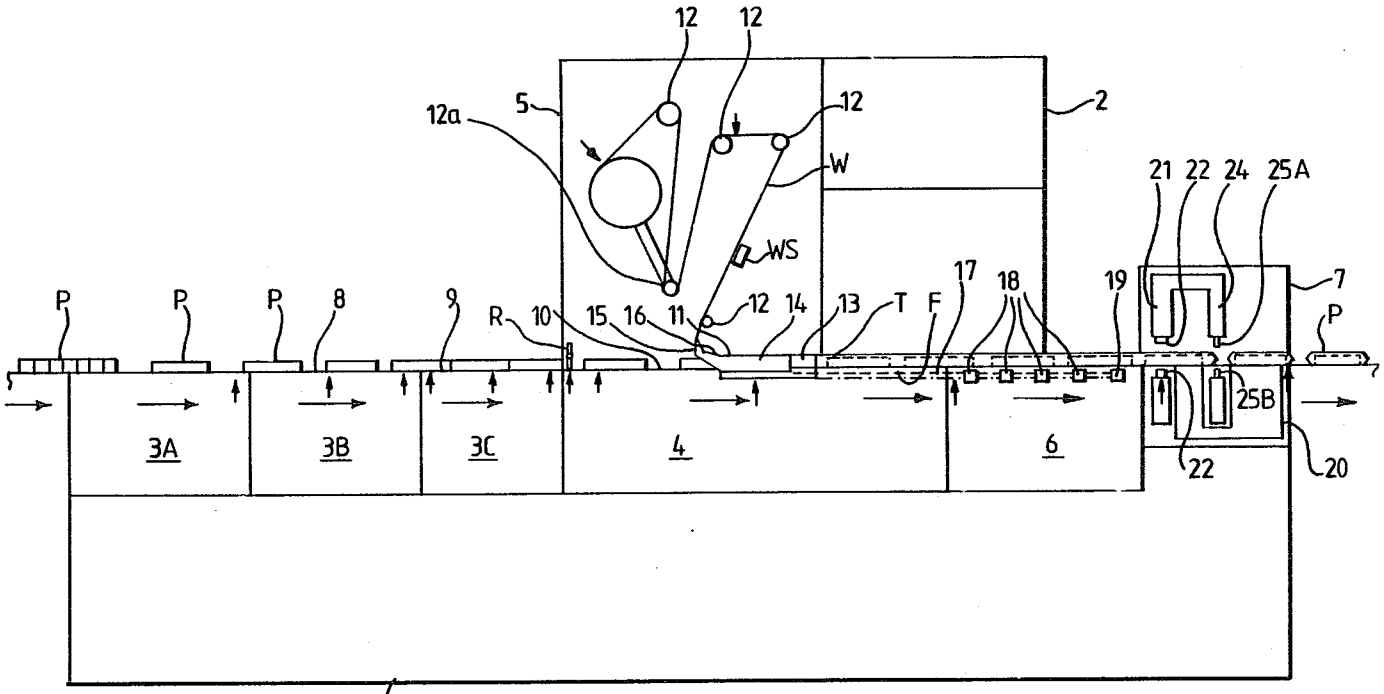
FIG. 3 is a schematic side view of the packaging machine of FIG. 1.

Referring to FIG. 1, a horizontal form-fill-seal (HFFS) packaging machine 1 consists of a series of mechanically independent modules, each carrying out a function in the packaging process controlled by a central processing unit 2 including a microprocessor. The microprocessor provides programmed control of the individual operation of the modules of the machine.

The modules each consist of a portable, self-contained unit. The modules are seated next to another forming the line of product travel. Each module is mechanically separate from each adjacent module so that it can be removed from the line without the need to disconnect it from the neighbouring module or modules. Hence, a module can easily be taken out of the machine if necessary and replaced by another module so as not to lose any production time.

The machine consists of a primary product infeed module (not shown), a streamer module 3A, second and third infeed modules 3B and 3C, a product-web registration and web-tube form module 4, a web infeed module 5, a longitudinal fin seal module 6, a transverse seal and cut-off module 7, and a product discharge/takeoff module (not shown) and a control panel (not shown).

The product, P, before and after wrapping travels in a straight line on the same level for maximum speed and reliability.

Each module is individually controlled and monitored by the central processing unit 2 to optimise its performance both individually and in relation to the other modules, particularly with regard to the passage of the product and web through the machine, which are photoelectrically sensed. The individual modules are each driven by a stepper motor under the control of the microprocessor. A suitable stepper motor is a DC stepper motor making 400 steps per rev. and 3000 revs. per minute (maximum).

The stepper motor, switches, sensors and all other parts of the module are mounted on the walls of the portable unit. The stepper motor is connected with the central processing unit through a plug-in distribution outlet attached to a cable harness so that when the module is removed, the distribution outlet can simply be unplugged.

The stepper motor of each module is controlled by the programmed microprocessor via a buffer clock card acting as a command interface and a drive card pulse generator. The microprocessor synchronises the modules with one another. The information sensed by each module may be used to control (a) that module itself, and (b) the timing relationship between that module and another module or modules, to provide a synchronised system.

The timing of the modules will be adjusted during operation of the process if necessary. The central processing unit will optimise the machine parameters in accordance with product size, web width, speeds of travel of product and web, product pitch, fin seal location, and transverse seal and cut-off timing and location.

The modules 3 to 7 have a start or "zero index" state so that they may be started synchronously and returned to the "zero index" position in the event of a problem in the packaging process e.g. interruption in flow or a machine fault. Attention may be paid to the problem and any necessary adjustments can be made; then the machine can be restarted automatically. The operation of the machine is monitored during start-up as well as during running.

Figure 4:
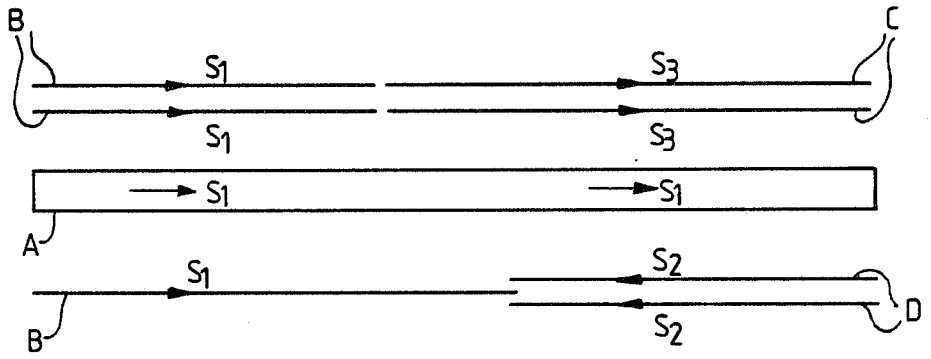
FIG. 4 is a schematic diagram of a streamer module.

A primary stage infeed conveyor (not illustrated) is located upstream of the HFFS machine for sequentially supplying groups of the products to be wrapped with their broad-sides facing the direction of travel, which reduces the pressure on the ends of the products and reduces the risk of damage to the product. The conveyor has a single endless belt running at speed $S_1$ under the control of the central processing unit 2 via a stepper motor. The product presence is sensed by two photoelectric sensors, one located about half-way along the conveyor and the other near the downstream end of the conveyor. Immediately following the primary infeed module is the streamer module 3A, which turns the products through 90° and into a single line. Referring to FIG. 4, products enter the module at speed $S_1$ and are transported on a central flat belt A and three side belts B acting in the same plane as the central belt, two on one side of the central belt and one on the other. Just before half-way along the module, the pair of side belts ends and a second pair of side belts C takes over, running at speed $S_3$, where $S_3$is greater than $S_1$. Further downstream, the single side belt ends and a third pair of side belts D begins, running at speed $S_2$ against the direction of travel, where speed $S_2$ is less than $S_3$ but greater than $S_1$.

When the end of the product meets the fastest side belts C, it is made to travel at that speed $S_3$ while the other end still travels at the slower speed $S_1$ and similarly, its other end is sent in the reverse direction when it meets the side belts D running in the reverse direction. The effect is that the products are turned through 90° and also land end-wise on the central belt A. The angle defined by a line through the two belt changeover positions assists in turning the products through 90° in their own length along the machine. It may be noted that one stepper motor is employed to drive belts of type A and B and a second stepper motor is employed to drive belts of type C and D, which are driven at different speeds by using differently sized drive rollers.

The relative speeds of the belts in the streamer module may be specified by the central processing unit to provide specific spacings between the ends of the products downstream. When the products leave the streamer module 3A they enter a second infeed module 3B on a belt-conveyor 8 followed by a third infeed module 3C having a belt-conveyor 9. Each module has three spaced sensors, which detect the presence or absence of product. The speeds of the belts of these modules and the previous modules can be adjusted to produce a required supply rate of products. Each belt is driven by a stepper motor controled by the microprocessor.

The supply rate required is such that all the products in the third infeed module should be end-to-end to produce a head of products to the next module if necessary. The second infeed module will accelerate the products from the streamer module to produce no gaps between products.

Means of defining product position in modular form may be provided in the infeed modules so as to be interchangeable, whereby different product pitches can be simply obtained for corresponding product lengths.

Immediately downstream of the third infeed module 3C is the web-registration and web-tube forming module 4. At the start of this module, a double arrester blade R is rotated anti-clockwise by a stepper motor via a ridged belt and roller arrangement. A pair of photoelectric sensors is employed, one just before the arrester and one after to check product presence and pitch. The arrester blade acts on the leading edge of each product. The arrester rotation is timed as will be discussed below. A belt conveyor 10, with longitudinal ridges disposed in the direction of travel, extends downstream as far as the downstream end of a web tube former 11.

The web tube former 11 is supplied with wrapping material from an overhead web feed module 5, from which web is fed from a stepper-motor-driven supply roll via five web tensioning rollers 12, the second of which is attached to a dancer arm **12*a*** hinged on the supply roll. The dancer arm includes an electronic linear potentiometer sensor, which works to a target in the position of the dancer arm and serves to vary the unwind speed so as to maintain a constant tension in the sheet from the top to the bottom of the parent supply roll.

Just before the final tensioning roller is mounted a web mark sensor WS for detecting the web mark printed at the leading edge of each package length. The package is intended to be sealed and cut on the web mark. The web mark detected for each respective packaging length is used to control the timing of the cross seal, and hence the seal position, for that package length as will be discussed in more detail below. This web mark is also used to control the timing of the release of the arrester blade earlier in the packaging procedure for the respective product which will be entubed by the package length bearing the web mark detected by the web sensor. This strict control results (a) in precise registration of each product with a specific length of packaging material and (b) in precise location of the seal and cut positions between products.

The web infeed module may include an optional stepper-controlled, date code printer.

The tube former 11 comprises a hollow, inverted-U-shaped longitudinal tube support 13 and a complementary inverted-U-shaped tube-forming portion 14 of a tube-forming member mounted over the support 13 and spaced therefrom by a distance slightly greater than maximum web thickness to provide a tight fit for the wrapping material in order to precisely control the tube shape. The forming member includes at its upstream end a web-infeed control surface 15 having its longitudinal axis substantially coincident with the axis of the web path and in the shape of a fish-tail. The web continuously tensioned by the fish-tail control surface 15 from the middle outwards to produce controlled uniform tension in the web, which flows between the former and the support. Between the tube forming portion 14 and the fish-tail 15 surface is an infeed guide surface 16. In use the web is guided beneath the fish-tail surface 15 and formed into a tube T between the inverted-U-shaped members 13 and 14.

The relative lengths of the web-infeed surface and the adjacent forming surfaces of inverted-U-shaped members 13 and 14 provide inversion of the web in a distance along the machine of 50–75% of the web width, normally 60%. The product to be wrapped is passed on a flat-bed conveyor through the hollow web tube support and the product passes off the conveyor into the web tube just as the formed tube leaves the former. A tense, self supporting tube T is formed and it is not necessary to use the product to support the tube T during and after forming. It is not necessary to provide external support for the product since the tensioned tube is strong enough to support the product, which acts as a secondary mandrel at this stage.

After leaving the former 11, a pair of guide walls 17 bring the two longitudinal edges of the formed tube together beneath the entubed product so that the edges form a fin F. The tightness of wrap can be increased by a pair of meshing contra-rotatory wheels between which the fin F is passed. The action of these wheels is assisted by their axes of rotation being inclined towards the direction of tube travel.

Immediately downstream of the web tube former module 4 is the fin seal module 6, which comprises a pair of spaced parallel guide walls 17 between which the tube fin F travels and above which is carried the entubed product. The module includes means for sensing product presence and monitoring product pitch by identifying a mark on the web. The fin is longitudinally, pressure-sealed on passage between at least four driven, cooperating, contra-rotatory fin-sealing wheels 18, which also pull the tube through the machine.

The fin seal module is the master module and the timing of the other modules or slave modules is set by the microprocessor in dependence of this module. The seal wheels are driven by a stepper motor controlled by the microprocessor. The contact surfaces of the wheels have a fine, intermeshing groove or alternatively smoothed and knurled surfaces; the surfaces are machined in a downward spiral.

The distance apart of all the pairs of wheels should be not less than the product length so that each package being made is under strict control. The path width provided for the free edges of the tube and the subsequent fin may be adjustable for different material thicknesses, particularly by varying the gaps between the pairs of wheels so that the tube is always as tight as possible around the product. At least one of the pairs of wheels may be employed to heat seal the fin if desired. A further pair of wheels 19 is disposed at the downstream end of the fin seal module, which are for turning the fin flat against the base of the product.

The positions of the longitudinal and transverse seals and of cut-off of individual packages from the tube can be accurately specified by the microprocessor and achieved for example by closely matching the web pattern with the product, monitoring the product flow, and the product pitch. The tightness of wrap can be maximized to use the least possible amount of material. The transverse seal is required to be made mid-way between consecutive products.

Immediately after the fin seal module, the tube containing the product passes onto a conveyor belt 20 in the seal and cut-off module 7, timing of this module being controlled by the central processing unit 2. In this module the entubed product passes through a seal arbour 21 carrying a pair of pressure sealing heads 22. The arbour 21 and belt 20 are each driven by stepper motors 23 controlled by a micro processor, as will be described below, at a speed which varies according to a predetermined pattern in such a way that the sealing heads form seals at intervals exactly equal to the package length, and as they do so they are travelling at the same linear speed as the tube T containing the product.

The seal and cut-off module 7 includes a second arbour 24 downstream of the first, and includes a cutter blade 25A and an anvil 25B. The cutter blade is driven by a second stepper motor. The arbour 24 is adjustable so that the distance between the sealing arbour 21 and the cutter arbour 24 may be matched to the package length; the heights of the arbour are also adjustable according to product height.

Referring now to FIG. 5, the shaft 25 of the seal arbour 21 carries an index 25, which will be confronting a sensor 27 at a datum position 180° from the sealing position. At each revolution of the arbour, the sensor 27 senses this index and provides an indexing pulse to the microprocessor MP. The microprocessor MP interfaces with high frequency clocking pulses from a clock 28 associated with the stepper motor of the seal arbour. The microprocessor MP includes a memory, which stores information as to the required patterns of pulses and intervals corresponding to different package lengths.

The packaging machine has a control panel provided with a row of setting buttons. These buttons provide means by which the machine may be started, initialized and caused to run up to and operate at each of its running speeds, which may for example be nine in number, stopped, and manually overridden. There are also selector buttons for selecting the package length and product packaging rate. In operation the required package length is first selected, and the machine is initialised by pressing the appropriate buttons. At the end of the initialisation, the shaft 25 is in its datum position, that is to say with the index 26 opposite the sensor 27. The operator then presses the button corresponding to the lowest of the present speeds of operation.

The selected package length and speed of operation are fed from the control panel into the microprocessor MP, where they select from the stored information, the corresponding pulse patterns to be sent to the seal head stepper motor 23 and determine the processor clock frequency below so that the seals are formed at intervals corresponding precisely to the length of the package. At each revolution the indexing pulse from the sensor 27 resets the stepper motor clock 28 automatically. At the same time, the clock count is compared with a similar count of a clock 29, associated with the web mark reader WS upstream for the next package length to be sealed, and if the clocks are not in a preselected synchronization, the central processor MP will correct the rotational speed pattern of the next revolution. The amount of correction will be assessed by the central processor MP depending on the relationship between the cycles of the seal clock 28 and of the clock of the web mark reader upstream. The seal is required to be made on the web mark every package length.

In one example, a complete revolution of the seal arbour stepper motor requires 400 pulses. The revolution may be divided into three sectors: a first sector of 166 pulses extends from the datum position to about 30° before the sealing position, a second sector of 68 pulses extends from about 30° before to about 30° after the sealing position, and a third sector of 166 pulses extends from the end of the second sector to the datum position. The central processor program ensures that the 68 pulses of the second sector are timed to synchronise movement of the sealing heads with that of the web and product, and the pulse rates in the first and third sectors are such as to ensure that the arbours make one revolution for each package length. The program provides for adjustment by a required number of pulses, for example a single pulse, to be inserted or omitted at each revolution as necessary to maintain synchronism of the seal position and web mark, so that the revolution might contain 399 or 401 pulses.

Having satisfied himself that the machine is running satisfactorily at the low speed, the operator may then, by pressing the appropriate buttons, select other speeds as required. The microprocessor is arranged to deal with the speed changes on starting up, or on changing from one speed to the next higher or next lower. Essentially, this is done by changing the effective clock rate of the microprocessor, but it is necessary to arrange that acceleration from one speed to the next is uniform, and takes place over a time interval which is long compared with the operating time per package. Since all the modules of the machine are driven in synchronism by the microprocessor, either directly or under control of the index pulses from the sensor 27, the whole machine may be uniformly speeded up or slowed down without losing synchronism.

The seal and cut-off module 7 is followed by a discharge conveyor for taking-off the individual packages. A flow sensor may be provided to check the continuance of product flow.

To summarise the operation of the packaging machine, a series of products P is fed broad-side on from the primary infeed conveyor into the streamer module 3A, in which the products are turned through 90° to form an end-way-on single file. The spacing of the line of products is regulated in the second infeed module 3B by processing sensed product data in the central processing unit 2 and adjusting the speed of the belt conveyor of the module as necessary to produce a required ratio of supply of product to the third infeed module 3C. The third infeed module 3C is required to acquire a head of products for supply to the next module in the packaging line, which is the web-registration and web-tube-form module 4.

This module is supplied with products from the infeed conveyors and with wrapping web material W containing a repeated package length design from the overhead web infeed module 6, in which the web is also sensed. This is carried out by a photoelectric sensor which detects an eye mark on the leading edge of every package length of wrapping material. Each package length is required to be precisely registered with each product. This is achieved by controlling a rotated registration head R at the upstream end of the module 4, which is turned out of its downwardly acting position at the instant when forward travel of the product behind the head is required. The registration head R is a blade mounted on a rotatable shaft at its centre, whereby the blade acts as a stop every half revolution, retarding the product behind should it have arrived too early. The timing of the product release command is controlled by the central processing unit 2 to be in appropriate relation to the sensing of the web mark by the web sensor WS in the web infeed module 5. The products P are taken on the belt conveyor 10 through the hollow support portion 13 of the tube former 11 which is disposed over the packaging line.

While the products flow through the former 11, wrapping material W is fed from an overhead web feed module 5 via tensioning rollers T to the web tube former, where the wrapping material is formed into a taut tube T. At the same time as the tube passes out of the former, the product is transferred into the tube in correct registration with the package design. The free edges of the tube are brought together under the product by the guide walls 16. The entubed product is then pulled through the tilted contra-rotatory wheels 18b, which pull the free edges tight under the product by the cooperating wheels in the fin seal modules. The longitudinal fin of the tube T is sealed and turned flat against the bottom of the product in the fin seal module 6. The transverse seal is made on the web mark in the seal and cut-off module 7 by timing the seal for each package in conjunction with the timing of the sensing of the same web mark by the sensor WS in the web infeed module. The package units are sequentialy detached from the tube by cutting mid-way along the transverse seal. The packages are then taken off by the discharge conveyor.

It should be noted that the packaging machine of the invention can be used to form packages comprising one or more items.

It will be appreciated that the packaging machine of the invention as defined in the claims provides highly accurate, synchronised, high speed automatic performance, under control of the central processing unit, which collects data as to the performance of the individual modules and sends out commands to individual modules in accordance with the required timing relationship between the modules.

The precise control by the microprocessor of the web-product registration and the position of the seal accommodates variations in web design but at the same time allows a minimum amount of wrapping material to be employed in any one package length design.

The basic modular design of the packaging machine provides a machine which can be efficiently fabricated, installed and maintained, and which affords minimal interruption to packaging when access to the machine is required.

I claim:

1. A horizontal form-fill-seal packaging machine including a series of mechanically separate modules, each said module including a stepper motor, conveyor means having an inlet and an outlet, which conveyor means is operatively connected to said stepper motor, and electrical plug and socket input means operatively connected to said stepper motor, said modules being arranged together in abutting relation in order to define a product travel path along which products to be packaged are conveyed, said product travel path being defined by said conveyor means with the outlet of the conveyor means of one module abutting the inlet of said conveyor means of the adjacent module, said machine including:

an infeed conveyor defined by at least two said modules, a web tube former including an inlet for packaging web, means operative to form said web into an inverted U-shaped tube with two spaced free edge portions, and an outlet for supplying said tube, a said module for web infeed, said conveyor means of said web infeed module being operatively associated with said tube outlet from said web tube former such that the products on said conveyor means are entubed, a first sealing module downstream of said web infeed module, and including means for bringing said two spaced free edge portions of the tube together into a fin beneath each said entubed product and for sealing said edge portions together, a second sealing module downstream of said first sealing module including a seal head for producing a transverse seal across said tube between products, and a control unit having an electrical output means operative to provide a respective control signal for input to said plug and socket input means of each said module to control a respective said stepper motor of said module.

2. A horizontal form-fill-seal packaging machine according to claim 1, wherein said infeed conveyor includes a said module for streaming products to be packaged in which said module of said infeed conveyor means is adapted for sequentially conveying products with their broad sides perpendicular to the direction of travel, and for sequentially turning the products into an end-wise orientation before said outlet of said conveyor means.

3. A horizontal form-fill-seal packaging machine according to claim 2, wherein said conveyor means of said streamer module includes a first central conveyor extending from said inlet to said outlet and operatively connected to said stepper motor in order to drive said first central conveyor at a first speed in a direction of product travel, a second conveyor positioned to one side of said first central conveyor and extending from an intermediate point downstream of said inlet for accelerating a first end of each product in or opposite to the direction of product travel, and a third conveyor extending from a point downstream of said intermediate point for sending the opposite end of said each product in the opposite direction to the direction of travel of the first end.

4. A horizontal form-fill-seal packaging machine according to claim 3, wherein said third conveyor is driven at a second speed, which is greater than the said first speed.

5. A horizontal form-fill-seal packaging machine according to claim 4, wherein said second conveyor is driven at a third speed, which is greater than said second speed.

6. A horizontal form-fill-seal packaging machine according to claim 1, wherein said web infeed module includes a driven product arrester member, and said web tube former includes a sensor having an output and being operative to produce an output signal at said output in response to the presence of a web mark in said fed web, which web marks are provided periodically along the web at intervals corresponding to the length of web required to package a single product, said control unit having an input connected to said output of said sensor, said control signal for said web infeed module controlling the timing of the action of the arrester to ensure precise registration of the product and web length.

7. A horizontal form-fill-seal packaging machine according to claim 6, wherein said second sealing module includes a further stepper motor operatively connected to said seal head and connected to said control unit to receive a respective control signal by said plug and socket means of said second sealing module, said control signal for said further stepper motor controlling the timing of said seal head in accordance with said output of said web mark sensor to ensure precise location of the seal between products.

8. A horizontal form-fill-seal packaging machine according to claim 7, wherein said second sealing module further includes a cutting arbour arranged downstream of said seal head for producing a transverse cut in the transverse seal produced by said seal head to separate individual packaged products, sensing means coupled to one or both of said seal head and cutting arbour for periodically producing an index pulse synchronized with the operation thereof, and means for connecting said index pulses to said control unit, said control unit being operable to produce said control signals for each said module with reference to said index pulses.

9. A horizontal form-fill-seal packaging machine according to claim 1, in which said control unit stores programs corresponding to a plurality of package lengths and means are provided whereby a machine operator instructs said control unit to select a program corresponding to a required package length.

* * * * *